United States Patent [19]

Kawai et al.

[11] 4,140,527

[45] Feb. 20, 1979

[54] NITROGEN CONTAINING POWDER METALLURGICAL TOOL STEEL

[75] Inventors: Nobuyasu Kawai; Katuhiko Honma, both of Kobe; Hirofumi Fujimoto, Ono; Hiroshi Takigawa, Kobe; Tsuneo Tatsuno, Akashi, all of Japan

[73] Assignee: Kobe Steel, Ltd., Kobe, Japan

[21] Appl. No.: 799,338

[22] Filed: May 23, 1977

[30] Foreign Application Priority Data

May 21, 1976 [JP] Japan ..... 51-57904

[51] Int. Cl.[2] ..... C22C 33/02; C22C 38/02; C22C 38/08; C22C 38/10

[52] U.S. Cl. ..... 75/244; 75/123 B; 75/123 J; 75/123 K; 75/123 M; 75/126 A; 75/126 B; 75/126 C; 75/126 E; 75/126 F; 75/126 H; 75/126 J; 75/128 B; 75/128 D; 75/128 F; 75/128 N; 75/128 T; 75/128 R; 75/128 V; 75/128 W; 75/128 Z

[58] Field of Search ..... 75/244, 243, 238, 239, 75/123 J, 123 B, 126 J, 126 C, 246, 123 K, 123 M, 126 A, 126 E, 126 F, 126 H, 126 B, 128 R, 128 B, 128 D, 128 F, 128 N, 128 T, 128 Z, 128 W, 128 V

[56] References Cited

U.S. PATENT DOCUMENTS

| | | | |
|---|---|---|---|
| 2,909,425 | 10/1959 | Hsiao et al. | 75/126 J X |
| 3,012,879 | 12/1961 | Schempp et al. | 75/126 J |
| 3,154,412 | 10/1964 | Kasak et al. | 75/126 J |
| 3,165,400 | 1/1965 | Roy et al. | 75/126 J |
| 3,627,514 | 12/1971 | Steven | 75/126 J X |
| 3,696,486 | 10/1972 | Benjamin | 75/206 X |
| 3,809,541 | 5/1974 | Steven | 75/244 X |
| 3,833,360 | 9/1974 | Giflo et al. | 75/126 J X |
| 3,836,406 | 9/1974 | Yoda | 75/126 J X |
| 3,859,081 | 1/1975 | Harvey et al. | 75/126 C |

FOREIGN PATENT DOCUMENTS

| | | | |
|---|---|---|---|
| 2259992 | 7/1973 | Fed. Rep. of Germany | 75/126 C |
| 2263576 | 7/1974 | Fed. Rep. of Germany | 75/126 C |
| 46-19774 | 6/1971 | Japan. | |
| 47-9900 | 3/1972 | Japan. | |
| 47-37810 | 9/1972 | Japan. | |
| 49-78606 | 7/1974 | Japan. | |
| 50-49109 | 5/1975 | Japan. | |
| 50-49156 | 5/1975 | Japan. | |
| 7629314 | 5/1976 | Japan | 75/126 C |
| 1244360 | 9/1971 | United Kingdom | 75/126 J |
| 338553 | 6/1972 | U.S.S.R. | 75/126 J |
| 500289 | 5/1976 | U.S.S.R. | 75/126 C |
| 519493 | 7/1976 | U.S.S.R. | 75/126 C |

OTHER PUBLICATIONS

Fischmeister, H. F. *Modern Techniques for Powder Metallurgical Fabrication of Low-Alloy and Tool Steels* In Powder Met., p. 151, 1975.

Kawai, N. et al. Preprint. Fall 1973 Meeting of the Japan Society Powder Metallurgy, pp. 104–106, 1973.

Kawai, N. et al. Tetsu to Hagane, 59 (11):S678, 1973.

Honma, K. et al. Powder Metallurgy - Special Edition, "Cutting Performance of Powdered High Speed Steel Tool".

*Primary Examiner*—Richard E. Schafer

*Attorney, Agent, or Firm*—Oblon, Fisher, Spivak, McClelland & Maier

[57] ABSTRACT

A nitrogen containing powder metallurgical tool steel comprising at least 0.40% N, 1.6 - 15% V, C in an amount satisfying the relationship of $$0.2 + 0.2\,V(\%) \leqq (C + N) < 0.5 + 0.2\,V(\%),$$

at least one element selected from the group consisting of up to 15% Cr, up to 10% Mo, up to 20% W and up to 15% Co, with balance iron.

4 Claims, 7 Drawing Figures

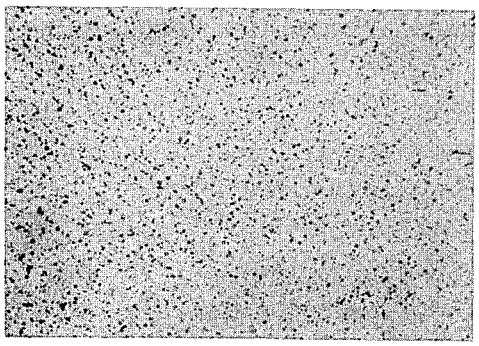
FIG. 6a (x400)
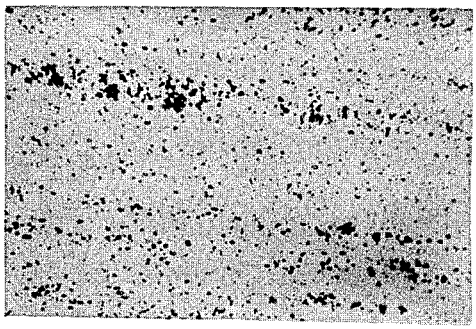
FIG. 6b (x400)

NITROGEN CONTAINING POWDER METALLURGICAL TOOL STEEL

BACKGROUND OF THE INVENTION

1. Field of the Art

The present invention relates to a tool steel, particularly to a nitrogen containing powder metallurgical steel (hereinafter referred to as "PM steel" ), wherein the amounts of C, N and V are properly adjusted.

2. Description of Prior Art

It is known that the properties of tool steels containing alloying elements such as Cr, W, and V can be improved by incorporation of nitrogen into the steels (see, for example, Kobe Steel Technical Bulletin, R & D, Vol. 24 No. 3, pages 11 to 15, and Japanese Patent Application Laid-Open Specifications Nos. 78606/74, No. 49109/75 and No. 49156/75), and these steels are widely used as jig materials such as die materials and cutting tool materials because they have good wear resistance and good heat resistance. By nitriding treatment, a nitride of the type MX or $M_6X$ (in which M stands for an alloying element and X stands for carbon or nitrogen) is formed, and this nitride is more stable than a carbide of the type MC or $M_6C$. Accordingly, the appropriate quenching temperature range is broadened and control of the heat treatment can be facilitated.

Further, the temper hardening characteristic is improved and a fine austenitic crystal structure can be obtained to improve the mechanical properties. Furthermore, the machinability of the steels can be improved.

According to Japanese Patent Publication No. 19774/1971, addition of 0.05 – 0.35% N to a die steel for high temperature service contributes to increase resistance to softening at high temperature, to suppress fatting of grain boundaries, and further contributes to suppress undue formation of delta ferrite.

Most conventional nitrogen containing tool steels have heretofore been prepared by a smelting process. When the smelting process is adopted for production of nitrogen containing tool steels, it is necessary to perform complicated steps such as the step of melting steel in a high pressure nitrogen atmosphere or the step of throwing a nitride into molten steel. Further, according to the smelting process, since the amount of nitrogen included in the steel is small and it is difficult to form a fine carbonitride and distribute it uniformly in steel, it is impossible to improve the properties to desirable levels.

As a means of overcoming the defects or limitations involved in the smelting process, methods have recently been proposed for obtaining nitrogen containing tool steels by the powder metallurgical process or the powder forging process. In those methods, by utilizing the fact that powder has a large specific surface area (surface area/volume) and the fact that a powder sintered body has a porous structure, an optional amount of nitrogen can be included in steel by a simple means, for example, by adding nitrogen in advance to the starting powder or adjusting the heating temperature, the heating time or the nitrogen partial pressure in the treatment atmosphere at the sintering step. It is expected that nitrogen will be fairly and uniformly distributed in steels according to these methods.

In conventional nitrogen containing PM steels, the machinability is not as highly improved as might be expected, as is apparent from Japanese Patent Publication No. 37810/1972. N is not a desirable element for stabilizing retained austenite when the steel is to be used for gauge. (see, for example, Japanese Patent Publication No. 9900/1972)

Rather, the machinability is degraded by incorporation of nitrogen into the steels. Accordingly, it is often said that the value of nitrogen containing high speed steels produced by powder metallurgical process is questionable. Moreover, several nitrogen containing high speed PM steels which have recently been put into practical use, have exhibited good machinability and good wear resistance in combination. The reason for this has not been elucidated. In particular, the relation between amounts of alloying elements which impart excellent machinability to steel and the amount of nitrogen enrichment is not clarified. Therefore, the kinds of steels which are enriched with nitrogen for the production of high speed PM steels and which are applicable are drastically limited. For example, Kobe Steel Technical Bulletin, R & D, Vol. 24, No. 3, page 10 discloses that when 0.4 – 0.5% N is added to Mo type high speed PM steels (JIS SKH 9 and modified JIS SKH 55), the machinability is remarkably improved.

Taking advantages of the fact that N addition is very advantageous for fine and uniform carbide, we carried out research on the improvement of various properties required for tool steel, particularly wear resistance and impact property with respect to various steel compositions. Then finally the present tool steel has been invented.

SUMMARY OF THE INVENTION

The object of the present invention is to solve problems involved with conventional nitrogen containing PM tool steels.

It is therefore a primary object of the present invention to provide nitrogen containing PM tool steels having excellent wear resistance and excellent impact property. Those and the other objects of the present invention can be attained by the features of the present invention which will hereinafter described in detail, referring to the drawings.

BRIEF DESCRIPTION OF THE DRAWINGS

FIG. 6*a* is photo showing the microstructure of the steel prepared by powder metallugical process.

FIG. 6*b* is a photo showing the microstructure of the steel prepared by smelting process.

DETAILED DESCRIPTION OF THE PREFERRED EMBODIMENTS

High speed steels are characterized by their excellent wear resistance and heat resistance because they contain large amounts of Mo, W and V which are carbide forming elements rather than Fe. Further they are relatively good in impact property, so that they have conventionally been used mainly as cutting tools.

Viewing the total characteristics of steels including, wear resistance, heat resistance, pressure resistance and impact property, high speed steels are superior to tool materials such as low and high temperature dies, and are used as working tools for low and high temperature services in addition to cutting tools.

In this case, the important problem is how to improve impact properties without degrading wear resistance. To this end, a heat treatment such as low temperature hardening is often adopted. On the other hand, suppressing C content is advantageous for improving impact property from the compositional view point, however, adversely affects the wear resistance.

We therefore conducted the following experiments seeking development of tool steels having both excellent wear resistance and impact property.

A typical example of a steel powder corresponding to JIS SKH 9 (comprising 0.5% C, 4.3% Cr, 5.1% Mo, 6.0% W, 2.0% V) is heretofore used. Nitrogen is incorporated in this steel and high speed steels differing in nitrogen content are prepared. In these high speed steels, the influence of the nitrogen content on the wear resistance and impact property was examined and the results shown in FIG. 1 were obtained.

Figure 1:
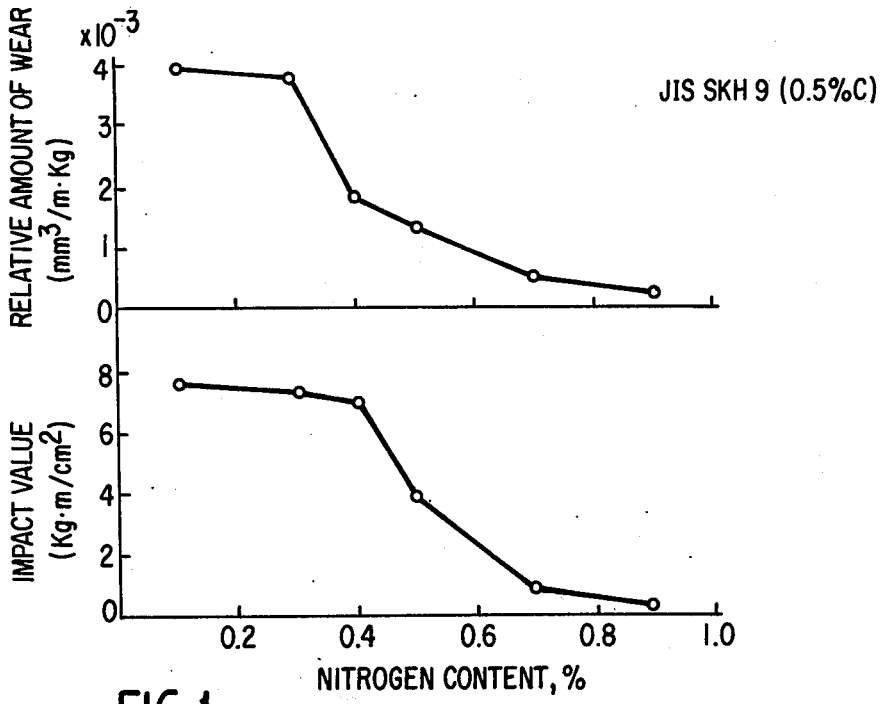
FIG. 1 is a graph showing the relationship between nitrogen content and properties of JIS SKH 9 steels containing approximately 0.5% C.

As is apparent from the results shown in FIG. 1, the wear resistance is remarkably improved when the nitrogen content is at least 0.40% while the impact value is good when the N content is less than 0.40%, but is apparently degraded when the N content is over 0.40%.

Carbon which is an essential element of high speed steels has general properties quite similar to those of nitrogen which is an addition element. Each of these elements has a very small atomic number of 6 or 7 and is an atom of interstitial type having a tendency to readily form an alloy compound.

Accordingly, it is deemed rather reasonable to adjust or regulate the nitrogen content in combination with the carbon content, for example, relying on such factors as the (C + N) content, or the C/N ratio irrespective of the C content. Moreover, it is desired to regulate or adjust the nitrogen content after due consideration of the contents of elements which have been admitted in the art as elements capable of forming carbides together with C and N in high speed steels, particularly V.

In view of the foregoing, as illustrated in the Examples hereinafter, steel powders corresponding to JIS SKH 9 or 10, which differ in carbon content, were prepared and nitrogen is incorporated in these steel powders in an amount of at least 0.40% necessary for improving the wear resistance of the steels. Then high speed steels were prepared from these powders by the powder metallurgical process, and they were tested with respect to the wear resistance and the impact property, and the results obtained are shown in FIGS. 2 - 5.

Figure 2:
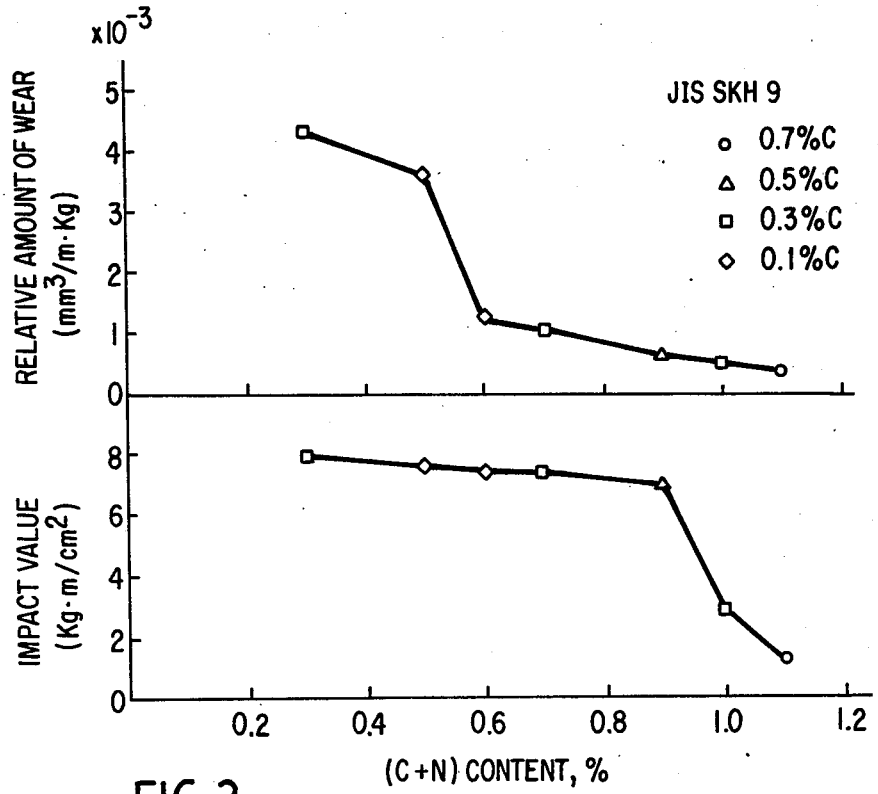
FIG. 2 is a graph showing the relationship between (C + N) content and properties of JIS SKH 9 steels containing 0.1 – 0.7% C.

FIG. 2 illustrates the results obtained with respect to the steels corresponding to JIS SKH 9 containing 1.95 - 2.04% V. It is seen from FIG. 2 that if the (C + N) content is more than 0.6%, the wear resistance is remarkably improved. While the impact property is good if the (C + N) content is less than 0.9%. Namely, in a nitrogen containing high speed PM steel which corresponds to JIS SKH 9, the (C + N) range appropriate for improving wear resistance without degrading impact property is 0.6 - 0.9%.

Figure 3:
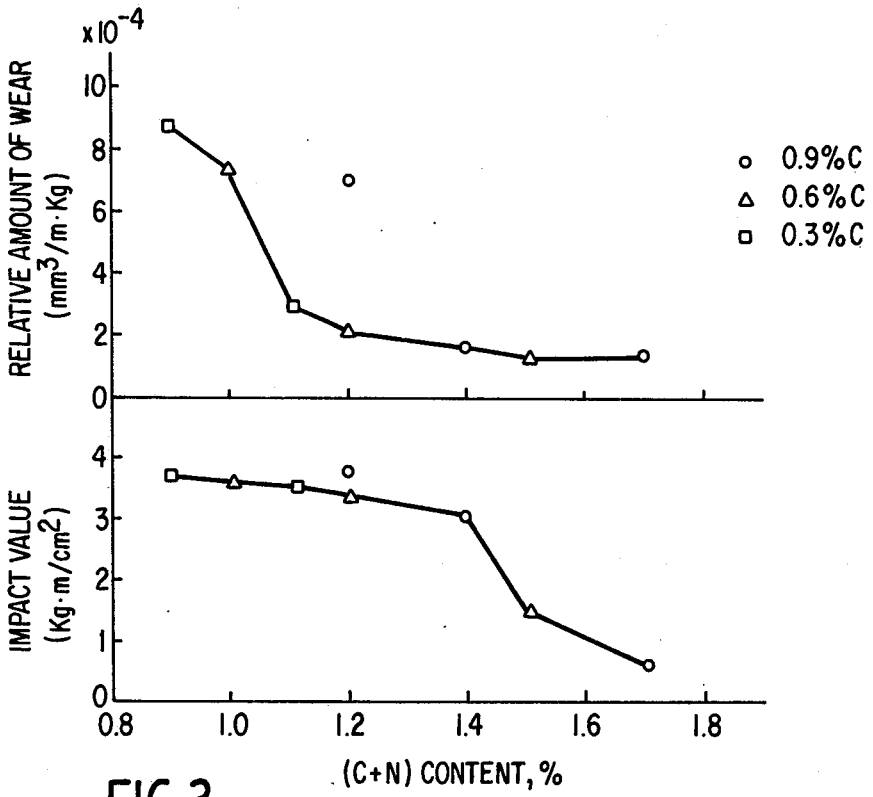
FIG. 3 is a graph showing the relationship between (C + N) content and properties of steels containing 0.3 – 0.9% C.

FIG. 3 illustrates the results obtained with respect to the steels corresponding to JIS SKH 10 containing 4.45 - 4.53% V. From FIG. 3, it is apparent that a suitable range of (C + N) content is 1.1 - 1.4%.

Figure 4:
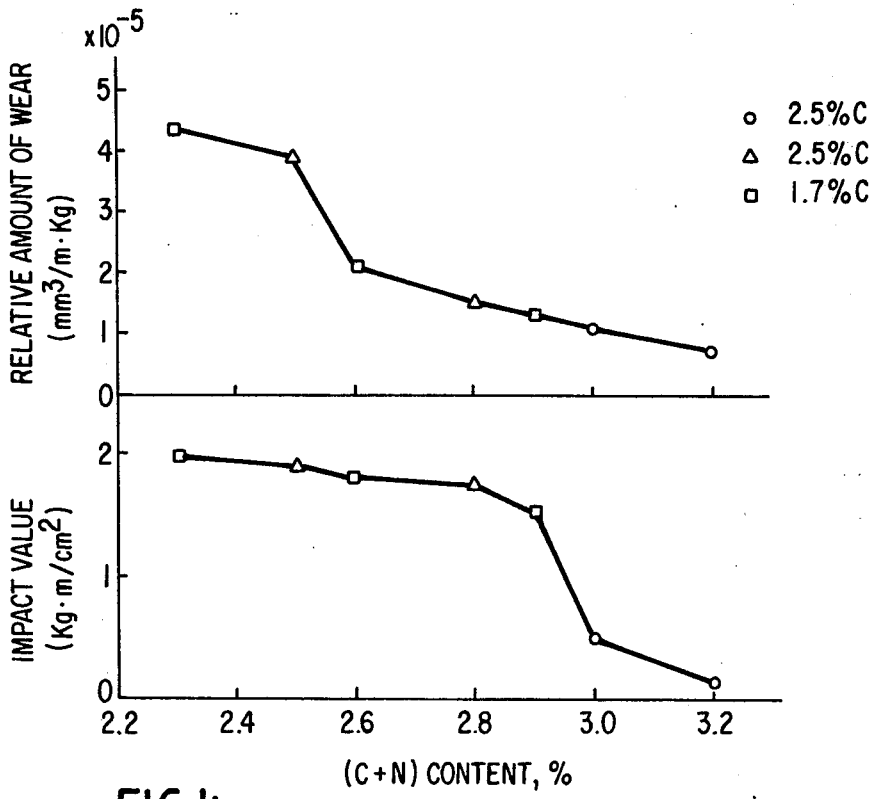
FIG. 4 is a graph showing the relationship between (C + N) content and properties of steels containing 1.7 – 2.5% C.

FIG. 4 illustrates the results obtained with respect to the steels having an increased V content, namely 4% CR — 3.5% Mo — 10% W — 12% V steels. In this case, a suitable range of (C + N) content is 2.6 - 2.9%.

Figure 5:
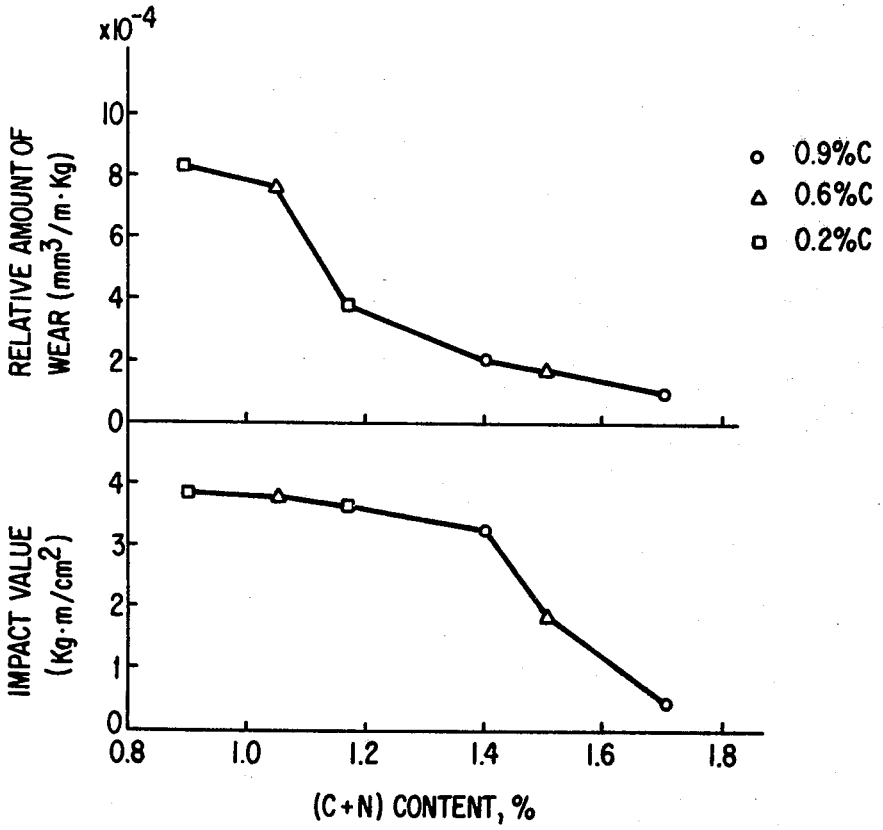
FIG. 5 is a graph showing the relationship between (C + N) content and properties of steels containing 0.2 – 0.9% C.

Further, FIG. 5 illustrates the results obtained with respect to the steels corresponding to AISI A7 containing 4.78 - 4.83 V and for use in cold working tool. In this case, a suitable range of (C + N) content is 1.15 - 1.45%.

If the foregoing experimented results obtained with respect to various high speed PM steels are collectively considered mainly in view of the (C + N) and V contents, it is apparent that in order to improve the impact property without degrading the wear resistance, the following requirement must be satisfied $$0.2 + 0.2\,V(\%) \leqq (C + N) < 0.5 + 0.2\,V(\%)$$

In this requirement, if the V content exceeds 15%, the toughness ordinarily decreases drastically because a vanadium type carbonitride is coarsened, and in such case, the above relationship which defines a suitable range of (C + N) content suitable for machinability, heat treatment properties, and machanical properties, is not satisfied.

Moreover, if the vanadium content is higher than 15%, since a vanadium type carbonitride is coarsened, the grindability and forging property are very substantially degraded. If the vanadium content is lower than 1.6%, it becomes practically difficult to enrich nitrogen to higher than 0.4%. Therefore vanadium must be at least 1.6%. No significant improvement of the machinability is attained if the nitrogen content is lower than 0.40%. In the present invention, it is preferred that the nitrogen content be at least 0.45%.

As is apparent from the foregoing experimental results, the above mentioned relationship, namely an appropriate range of the (C + N) content, is not changed in various high speed steels differing in content of such metals as Cr, Mo, W and Co.

In the PM tool steels according to the present invention, there are tool steels called alloy tool steels containing relatively small amounts of Cr, Mo, W, Si, Mn, and Ni with proper amounts of N, C and V, and there are the other type of tool steels called high speed steels containing increased amounts of those alloying elements, and there are also the tool steels containing intermediate amounts of those elements. In general, in tool steels, Cr is added in an amount of up to 15%, Mo is added in an amount of up to 10%, W is added in an amount of up to 20% and Co is added in an amount of up to 15%. Further, according to need, up to 3% Ni, up to 1% Mn, and up to 1% Si may be added. Furthermore, up to 2% Zr, up to 5;1 % Nb, up to 1% B may also be added.

The tool steels mentioned above are widely adopted as metal molds such as a press tool, trimming die, drawing die, and as jigs such as a chisel, punch, and gauge.

The present invention will now be described by reference to the following Examples.

EXAMPLE I

Gas atomized steel powders corresponding to JIS SKH 9 and differing in carbon content were packed in mild steel cans, subjected to degasification and nitriding treatments and then compression formed by a hot isostatic press to a heat treatment. The preparation conditions and the tests for determining wear resistance and impact property are illustrated below.

(1) Preparation Conditions (a) Chemical Composition and Grain Size of Starting Powder The starting powders used are shown in Table 1.

(b) Nitriding Treatment

The nitriding treatment was conducted at 1150° C for 2 hours in a nitrogen atmosphere. The pressure of the atmosphere was appropriately controlled to adjust the nitrogen content in the product steel.

(c) Hot Isostatic Press Treatment

Hardening: 1100° C X 2 hours under 2000 atm

Table 1

| Kind of Steel | Composition (%) | | | | | | | | | | | Grain Size |
|---|---|---|---|---|---|---|---|---|---|---|---|---|
| | C | Si | Mn | P | S | Cr | Mo | W | V | O | N | |
| A (0.7%C) | 0.70 | 0.29 | 0.27 | 0.01 | 0.03 | 4.30 | 5.01 | 6.12 | 1.95 | 0.010 | 0.021 | smaller than 80 mesh |
| B (0.5%C) | 0.49 | 0.25 | 0.24 | 0.01 | 0.04 | 4.35 | 5.12 | 6.06 | 2.00 | 0.030 | 0.015 | smaller than 80 mesh |
| C (0.3%C) | 0.32 | 0.31 | 0.32 | 0.01 | 0.03 | 4.11 | 4.97 | 6.15 | 2.04 | 0.035 | 0.018 | smaller than 80 mesh |
| D (0.1%C) | 0.11 | 0.32 | 0.29 | 0.01 | 0.02 | 4.05 | 4.91 | 6.08 | 2.01 | 0.040 | 0.017 | smaller than 80 mesh |

(d) Heat Treatment

Hardening: 1150° C × 5 minutes (Oil Quenching)

Tempering: repeated 2 - 4 times with heating pattern of of 450 - 550° C × 1.5 hours, intending to obtain hardness of HRC 59 - 60.

(2) Test Conditions (a) Wear resistance test

Load: 4.5 Kg

Friction Length: 550 m

Friction Speed: 2.5 m/sec

Material to be applied: JIS SCM 4 (Q.T.), $H_B$ 300 - 350

Lubricant: no (b) Impact Test

R-notch 10 mm square Sharpy Test (3) Results of Test

Test results are shown in FIG. 2. As is apparent from the results shown in FIG. 2, in nitrogen containing high speed PM steels containing 2% V, in order to improve the wear resistance without degrading the impact property, the nitrogen content must be at least 0.4%, and a suitable (C + N) content is 0.6 - 0.9%. If the nitrogen content is lower than 0.4%, nitriding effect is not adequate. If the (C + N) content is lower than 0.6%, nitride precipitates are few, and the wear resistance of the steel is degraded, while if over 0.9%, decrease in impact value is drastic.

With respect to a nitrogen containing high speed PM steel which is shown in FIG. 2 and comprises 0.3% C and 0.4% N, intermittent cutting test with a cutting tool of this steel was conducted in the following conditions.

Tool hardness: HRC 64

Tool shape: 0°, 15°, 6°, 6°, 15°, 10 R

Cutting speed: 25 m/min

Cut depth: 1.5 mm

Feed rate: 0.2 mm/revolution

Material machined: JIS SCM 4 (Q.T.) $H_B$ 250 - 270

The cutting property of this tool was confirmed to be equivalent to that of a cutting tool consisting of JIS SKH 9 high speed steel produced by smelting.

EXAMPLE II

Atomized steel powders corresponding to JIS SKH 10 and differing in carbon content as shown in Table 2 were used as the starting powders and prepared into nitrogen containing high speed PM steels in the same manner as described in Example I. The wear resistance and the impact value was measured and the results obtained are shown in FIG. 3. As is apparent from the results shown in FIG. 3, a (C + N) content effective for improving the wear resistance without degrading the impact value is 1.1 - 1.4%. But when the (C + N) content is within the range of 1.1 - 1.4% if N content is approximately 0.3%, then the improvement in the wear resistance is inadequate as shown in FIG. 3.

Table 2

| Kind of Steel | Composition (%) | | | | | | | | | | | Grain Size |
|---|---|---|---|---|---|---|---|---|---|---|---|---|
| | C | Si | Mn | P | S | Cr | W | V | Co | O | N | |
| E (0.9%C) | 0.91 | 0.25 | 0.25 | 0.02 | 0.03 | 3.91 | 12.3 | 4.53 | 4.85 | 0.035 | 0.031 | smaller than 28 mesh |
| F (0.6%C) | 0.59 | 0.31 | 0.29 | 0.01 | 0.03 | 4.12 | 12.8 | 4.48 | 4.92 | 0.021 | 0.063 | smaller than 28 mesh |
| G (0.3%C) | 0.31 | 0.32 | 0.25 | 0.02 | 0.04 | 4.07 | 12.5 | 4.45 | 5.01 | 0.036 | 0.040 | smaller than 28 mesh |

EXAMPLE III

Gas-atomized steel powders containing approximately 12% V and differing in carbon content as shown in Table 3 where used as the starting powders and prepared into nitrogen containing high speed PM steels in the same manner as described in Example I. The wear resistance and the impact value were measured and the results obtained are shown in FIG. 4.

Table 3

| Kind of Steel | Composition (%) C | Si | Mn | P | S | Cr | Mo | W | V | O | N | Grain Size |
|---|---|---|---|---|---|---|---|---|---|---|---|---|
| H (2.5%C) | 2.50 | 0.29 | 0.31 | 0.01 | 0.02 | 4.01 | 3.56 | 10.3 | 12.2 | 0.041 | 0.18 | smaller than 80 mesh |
| I (2.0%C) | 2.01 | 0.29 | 0.30 | 0.01 | 0.02 | 4.04 | 3.61 | 9.8 | 12.3 | 0.030 | 0.18 | smaller than 80 mesh |
| J (1.7%C) | 1.69 | 0.35 | 0.30 | 0.02 | 0.03 | 4.09 | 3.75 | 10.4 | 11.8 | 0.050 | 0.15 | smaller than 80 mesh |

As is apparent from the results shown in FIG. 4, a suitable (C + N) content effective for improving the wear resistance without degrading the impact value is 2.6 – 2.9%.

EXAMPLE IV

Gas-atomized steel powders corresponding to AISI A7 shown in Table 4 were used as the starting powders and prepared into nirogen containing high speed PM steels in the same manner as described in Example I. The wear resistance and the impact value were measured and the results obtained are shown in FIG. 5.

Table 4

| Kind of Steel | Composition (%) C | Si | Mn | P | S | Cr | Mo | W | V | O | N | Grain Size |
|---|---|---|---|---|---|---|---|---|---|---|---|---|
| K (.09%C) | 0.92 | 0.31 | 0.32 | 0.02 | 0.03 | 5.20 | 0.96 | 1.06 | 4.78 | 0.040 | 0.046 | smaller than 28 mesh |
| L (0.6%C) | 0.61 | 0.25 | 0.29 | 0.02 | 0.03 | 5.12 | 1.05 | 0.96 | 4.81 | 0.041 | 0.038 | smaller than 28 mesh |
| M (0.3%C) | 0.29 | 0.35 | 0.35 | 0.02 | 0.04 | 5.30 | 1.03 | 1.05 | 4.83 | 0.035 | 0.035 | smaller than 28 mesh |

As apparent from the results drown in FIG. 5, (C + N) content effective for improving the wear resistance without degrading the impact value is 1.15 – 1.45%.

EXAMPLE V

Two kinds of steels corresponding to JIS SKH 9 containing relatively small amount of nitrogen, which are prepared by powder metallurgical process and by smelting (melting + forging) process, respectively, were tested with respect to the wear resistance and impact property. The chemical composition of these steels are shown in Table 5.

Table 5

| Kind of Steel | Composition (%) C | Si | Mn | P | S | Cr | Mo | W | V | O | N |
|---|---|---|---|---|---|---|---|---|---|---|---|
| N. PM Steel JIS SKH 9 | 0.91 | 0.30 | 0.30 | 0.01 | 0.03 | 4.15 | 4.91 | 6.03 | 1.98 | 0.006 | 0.02 |
| O. Smelted Steel JIS SKH 9 | 0.87 | 0.31 | 0.28 | 0.02 | 0.03 | 4.06 | 4.89 | 6.12 | 1.96 | 0.004 | 0.03 |

The results of the tests are shown in Table 6.

Table 6

| Steels | relative amount of wean ($mm^3/m.Kg$) | Impact value ($Kg.m/m^2$) |
|---|---|---|
| N | $2.2 \times 10^{-3}$ | 5.5 |
| O | $2.1 \times 10^{-3}$ | 4.2 |

As a result, impact value of the PM steel (N) is improved, because the microstructure of the PM steel is uniform and fine compared with the mirostructure of the smelted steel (0), as apparent from FIG. 6*a* and FIG. 6*b*.

EXAMPLE VI

Gas-atomized steel powder corresponding to JIS SKH 10, containing 1.5% C, 0.4% N, are tested according to Example I. The chemical composition is shown in Table 7, and the results obtained is shown in Table 8.

Table 7

| | Composition (%) C | si | Mn | P | S | Cr | Mo | W | V | Co | O | N |
|---|---|---|---|---|---|---|---|---|---|---|---|---|
| (p) N containing PM steel JIS SKH 10 | 1.51 | 0.15 | 0.29 | 0.02 | 0.03 | 3.98 | — | 11.8 | 4.51 | 4.71 | 0.005 | 0.40 |

Table 8

| Steel | relative amount of wear $mm^3/mKg$ | impact value ($Kg.m/cm^2$) |
|---|---|---|
| P | $2.3 \times 10^{-4}$ | 0.53 |

As apparent from Table 8, the amount of wear and the impact value are as same as those of the steels containing 1.7% (C + N) in FIG. 3.

Be it noted that Steels N, O and P are out of the limitations of the present invention and are shown for comparison with the steels of the present invention.

As is readily apparent from the foregoing illustration, in the nitrogen containing PM tool steel according to the present invention, excellent wear resistance and excellent impact property are obtained by adjusting and controlling the content of C, N and V so that the following requirements are satisfied:

$N \geqq 0.40\%$, more preferably $N \geqq 0.45\%$, $1.6 \leqq V \leqq 15\%$ and $0.2 + 0.2V(\%) \leqq (C + N) < 0.5 + 0.2V(\%)$.

Further, the steel of the present invention may contain at least one element selected from the group consisting of up to 15% Cr, up to 10% Mo, up to 20% W and up to 15% Co.

In addition, according to need, up to 3% Ni, up to 1% Mn and up to 1% Si may be incorporated in the steel. Furthermore, the steel may contain up to 2% Zr, up to 5% Nb, and up to 1% B.

What is claimed as new and intended to be secured by Letters Patent is:

1. A nitrogen containing high speed tool steel produced by hot isostatic pressing by the powder metallurgical process which comprises; at least 0.40%N, 1.6 – 15% V, C in an amount satisfying the relationship of $$0.2 + 0.2\,V(\%) \leqq (C + N) < 0.5 + 0.2\,V(\%),$$

at least one element selected from the group consisting of up to 15% Cr, up to 10% Mo, up to 20% W and up to 15% Co;

optionally at least one element selected from the group consisting of up to 3% Ni, up to 1% Mn, up to 1% Si, up to 2% Zr, up to 5% Nb and up to 1% B; and with the balance iron.

2. The nitrogen containing powder metallurgical tool steel as set forth in claim 1, wherein at least 0.45% N is contained.

3. The nitrogen containing powder metallurgical tool steel as set forth in claim 1, wherein said steel further comprises at least one element selected from the group consisting of up to 3% Ni, up to 1% Mn and up to 1;1 % Si.

4. The nitrogen containing powder metallurgical steel as set forth in claim 1, wherein said steel further comprises at least one element selected from the group consiting of up to 2% Zr, up to 5% Nb and up to 1% B.

* * * * *

UNITED STATES PATENT AND TRADEMARK OFFICE

CERTIFICATE OF CORRECTION

PATENT NO. : 4,140,527

DATED : February 20, 1979

INVENTOR(S) : Nobuyasu Kawai et al.

It is certified that error appears in the above-identified patent and that said Letters Patent are hereby corrected as shown below:

Column 2, line 24, change "advantages" to --advantage--;

Column 2, line 41, after "hereinafter", insert --be--;

Column 2, line 60, before "photo", insert --a--.

Column 4, line 7, delete "CR", and insert --Cr--;

Column 4, line 14, change "experimented" to --experimental--;

Column 4, line 28, change "machanical" to --mechanical--;

Column 4, line 58, after "5", delete ";1".

Column 5, line 60, change "Sharpy" to --Charpy--.

Column 6, line 64, change "where" to --were--.

Column 7, line 21, change "nirogen" to --nitrogen--;

Table 4, Column 1, line 4, change ".09" to --0.9--;

Column 7, line 38, change "drown" to --shown--.

Column 8, Table 6, heading of column, change "wean" to --wear--;

Column 8, line 22, change "mirostructure" to --microstructure--;

UNITED STATES PATENT AND TRADEMARK OFFICE

CERTIFICATE OF CORRECTION

PATENT NO. : 4,140,527

DATED : February 20, 1979

INVENTOR(S) : Nobuyasu Kawai et al.

It is certified that error appears in the above-identified patent and that said Letters Patent are hereby corrected as shown below:

Table 7,.column 3, heading, chnage "si" to --Si--;

Column 8, line 42, change "is" to --are--.

Column 10, line 20, after "1" (second occurrence), delete ";1".

Signed and Sealed this

*Twenty-sixth* Day of *February 1980*

[SEAL]

*Attest:*

SIDNEY A. DIAMOND

*Attesting Officer*

*Commissioner of Patents and Trademarks*